United States Patent [19]

Hain et al.

[11] Patent Number: 4,733,645

[45] Date of Patent: Mar. 29, 1988

[54] FUEL INJECTION PUMP FOR INTERNAL COMBUSTION ENGINES

[75] Inventors: Josef Hain, Leonberg; Karl-Friedrich Russeler, Ditzingen, both of Fed. Rep. of Germany

[73] Assignee: Robert Bosch GmbH, Stuttgart, Fed. Rep. of Germany

[21] Appl. No.: 859,541

[22] Filed: May 5, 1986

[30] Foreign Application Priority Data

May 18, 1985 [DE] Fed. Rep. of Germany ..... 3517974

[51] Int. Cl.[4] ..... F02M 39/00

[52] U.S. Cl. ..... 123/502; 123/179 L

[58] Field of Search ..... 123/502, 449, 179 L, 123/500, 501, 458, 457, 387

[56] References Cited

U.S. PATENT DOCUMENTS

| | | | |
|---|---|---|---|
| 4,359,994 | 11/1982 | Hofer | 123/502 |
| 4,395,990 | 8/1983 | Hofer | 123/502 |
| 4,430,974 | 2/1984 | Bofinger et al. | 123/387 |
| 4,475,521 | 10/1984 | Grener | 123/502 |
| 4,489,698 | 12/1984 | Hofer | 123/502 |
| 4,510,908 | 4/1985 | Eisele | 123/449 |
| 4,619,238 | 10/1986 | Hain | 123/449 |

*Primary Examiner*—Carl Stuart Miller

*Attorney, Agent, or Firm*—Edwin E. Greigg

[57] ABSTRACT

A fuel injection pump for internal combustion engines which has an rpm-proportional injection onset adjusting device, a pressure control valve controlling the supply pressure (phd f), a cold-start acceleration device having a pressure valve associated with the pressure control valve, and a full-load stop, controlled by an adjustment device, for limiting the maximum full-load quantity injected by the fuel injection pump. The adjustment device has a piston, which is acted upon on one end by the supply pressure in the suction chamber of the injection pump and on the other end by a pressure ($p_a$) that is made to differ from the supply pressure by means of two separate throttles. The two throttles have the effect that if the pressure valve is closed, the adaptation device is subjected to a differential pressure which is approximately equal to that when the pressure valve is opened, and so the full-load courses attained in normal operation and in cold operation are virtually identical.

3 Claims, 3 Drawing Figures

FUEL INJECTION PUMP FOR INTERNAL COMBUSTION ENGINES

BACKGROUND OF THE INVENTION

The invention is based on a fuel injection pump as defined hereinafter. In an injection pump of this type, known for instance from U.S. Pat. No. 4,430,974 of Bofinger et al, the injection onset and the course of the full-load quantity, when the engine is operated when cold, are varied by the temperature-dependently controlled pressure valve of a cold-start acceleration device and by the hydraulically controlled supply quantity adaptation device, hoth of which are connected to the pressure control valve. It has now been found that the courses of the full-load quantity during normal operation and cold operation are very different because of the pressure equilibrium in the restoring chamber of the pressure control valve and in the adaptation chamber of the adjustment device; as a result, the running up of the engine in the warmup phase is very unfavorably affected.

OBJECT AND SUMMARY OF THE INVENTION

The fuel injection pump according to the invention has the advantage over the prior art that by adding two throttle devices, on the one hand for the restoring chamber of the pressure control valve or the cold-start acceleration device, and on the other hand for the adaptation chamber of the adaptation device, a virtually identical pressure difference between the suction chamber pressure and the pressure in the adaptation chamber is attained in a simple manner. As a result, since the supply quantity is directly dependent on this differential pressure, virtually identical full-load supply quantity courses are attained in both normal operation and during the warmup phase of the engine, and so the engine performs well even in the warmup phase when the injection onset is shifted toward "early".

The invention will be better understood and further objects and advantages thereof will become apparent from the ensuing detailed description of a preferred embodiment taken in conjunction with the drawings.

DESCRIPTION OF THE PREFERRED EMBODIMENT

Figure 1:
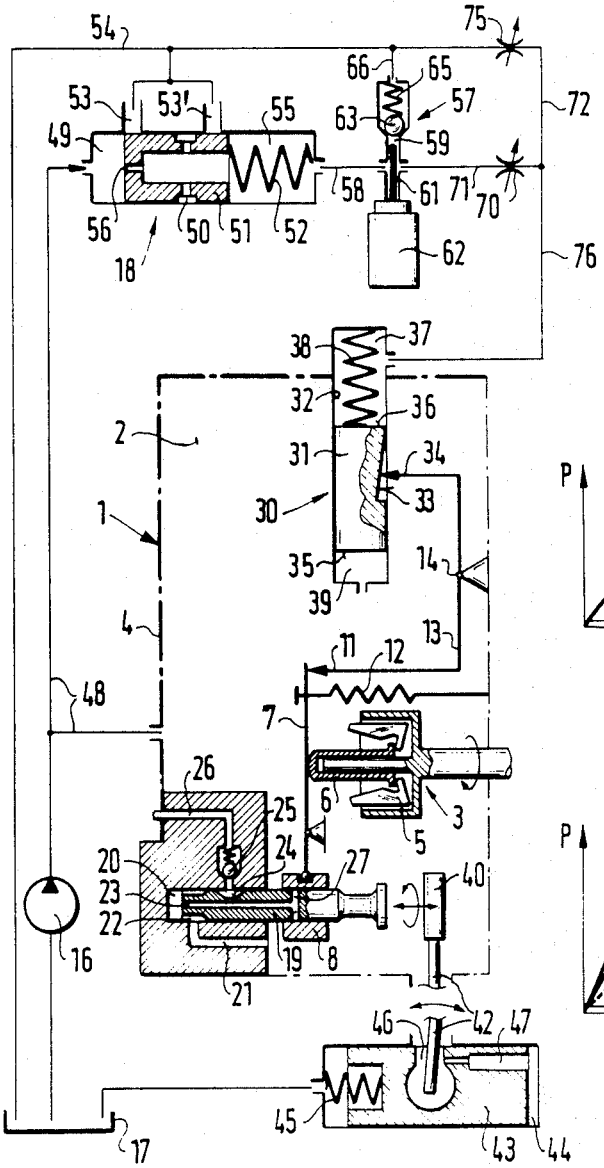
FIG. 1, in simplified form, shows a fuel injection pump of the distributor type in cross section.

The fuel injection pump 1 has a mechanical rpm governor 3 in a suction chamber 2 surrounded by a housing 4. Via a governor sleeve 6 and a governor lever 7, flyweights 5 of the rpm governor actuate an annular slide 8, acting as a supply quantity adjusting member, in a known manner. The position of the annular slide 8, controlled by the governor lever 7, controls the end of supply of a given injection supply quantity. In the full-load position shown, the governor lever 7 rests on a full-load stop 11. The biasing force of a governor spring 12 that keeps the governor lever 7 in contact with the full-load stop 11 determines the breakaway rpm. The full-load stop 11 is embodied on a stop lever 13, which is embodied as a two-armed lever that is pivotably supported about a shaft 14 integral with the housing. Fuel is delivered from a fuel tank 17 by a feed pump 16 to the interior of the fuel injection pump housing 4, which serves as a suction chamber 2; the fuel pressure on the compression side of the feed pump 16 is controlled by a pressure control valve 18 as a function of rpm.

A pump work chamber 20 acted upon by a pump piston 19 that simultaneously reciprocates and rotates is filled during the intake stroke of the pump piston 19 via an intake bore 21 and control grooves 22 of the pump piston 19, and during the compression stroke of the pump piston, with the intake bore 21 closed, fuel is pumped via a longitudinal bore 23 and a supply groove 24 communicating with it, and further via a check valve 25 and a pressure line 26, to an injection nozzle, not shown in detail, on a cylinder of the engine. At the end of supply, a transverse bore 27 of the pump piston that communicates with the longitudinal bore 23 is opened by the annular slide 8.

The position of the stop lever 13 and hence of the full-load stop 11 is determined by an adjustment device 30, which has a control member embodied as an adaptation piston 31, which is displaceably supported in a working bore 32 integral with the housing. A control cam 33 is formed on the circumference of the piston 31, and a feeler 34 of the stop lever 13 rests on this cam 33. The fuel pressure in the suction chamber 2 is exerted upon one end face 35 of the adaptation piston 31, while contrarily the other end face 36 of the piston 31 defines a chamber 37, in which a spring 38 is and arranged which is supported on the end face 36 of the piston 31.

The known cam drive 40 of the fuel injection pump 1 is engaged via a pin 42 by an adjusting piston 43 for adjusting the instant of injection onset. The longitudinal axis of the adjusting piston 43 extends at right angles to the plane of the drawing; however, for the sake of illustration the adjusting pin 43 is shown in the drawing rotated into the plane of the drawing. The adjusting piston 43 is displaceable by the pressure of fluid in a work chamber 44 counter to the force of a restoring spring 45, in such a manner that the farther the adjusting piston 43 is displaced toward the restoring spring 45, the more the instant of injection is shifted toward "early" with respect to top dead center of the engine piston. A connecting conduit 46 leads from the suction chamber 2 of the fuel injection pump 1 to a bore 47 in the adjusting piston 43 which discharges into the work chamber 44.

A pressure line 48 upstream of the feed pump 16 leads not only to the suction chamber 2 but also to a pressure chamber 49 of the pressure control valve 18. The fuel pressure prevailing upstream of the feed pump 16, which is also the pressure in the suction chamber 2, is controlled by the pressure control valve 18, and the pressure rises in proportion with the increase in rpm. This rpm-dependent pressure also prevails in the work chamber 44, so that with increasing rpm and thus increasing pressure, the adjusting piston 43 is displaced toward "early". The pressure control valve 18 functions with a piston 51 acting as a movable wall, which defines the pressure chamber 49 and upon its stroke counter to the action of a control spring 52 progressively opens up a diversion opening 53, by way of which fuel can flow into a return line 54 and from there back to the fuel tank 17. A restoring chamber 55 receiving the control spring 52 is disposed on the end of the piston 51 remote from the pressure chamber 49 and communicates with the pressure chamber 49 via a throttle bore 56 in the piston 51. This restoring chamber 55 is also progressively opened up, during the stroke of the piston 51, via a control groove 50 and a second diversion opening 53', so that fuel can flow into the return line 54 from the restoring chamber 55 as well. As a result, as the rpm increases the pressure drops, both in the restoring chamber 55 and in the pressure chamber 49 of the pressure control valve 18.

As is well known, injection in a Diesel engine occurs when the engine piston is in the vicinity of its top dead center. The instant of the injection onset is thus located from shortly before to shortly after top dead center, depending on the rpm; in general, it is earlier at higher rpm than at lower rpm. While the time required for the fuel to travel from the fuel injection pump to the injection nozzle remains largely constant, regardless of the rpm, the time required from pump supply to combustion does vary as a function of the rpm. This variation in the time is compensated for by the injection timing adjuster, which devotes a majority of its working capacity to this task. The remaining working capacity serves, depending on the requirement, to improve fuel consumption, performance, engine noise and/or exhaust gas quality. Since the ignition delay in a Diesel engine is known to be dependent on the temperature of the fuel and of the cylinder wall, it is advantageous, in order to compensate for this ignition delay when the engine is cold, to shift the injection onset earlier at low rpm. With a warm engine, however, this shift toward "early" would cause rough operation, and the engine would be noisy. It is also known that a shift toward "early" is favorable after starting, to attain rapid running up of the engine. A further characteristic of the cold engine is that with an early injection onset it produces less blue smoke than with a late injection onset.

For engine warmup, it is advantageous for the fuel pressure in the suction chamber 2, and hence in the work chamber 44 of the adjusting piston 43, to be relatively elevated, so as to attain a temporary additional shift of injection onset toward "early". However, pressure elevation necessitates a reduction in the diversion cross section at the diversion opening 53 of the pressure control valve 18 for the returning fuel quantity. To effect a temperature-dependent variation in the fuel flow during engine starting, a pressure valve 57 of a cold-start acceleration device is therefore provided in series with the pressure control valve 18. To this end, an outflow conduit 58 leads from the restoring chamber 55 of the pressure control valve 18 to a diversion chamber 59 of the pressure valve 57, which represents the cold-start acceleration device. Protruding into the diversion chamber 59 is an actuating member 61 of a temperature-dependent element 62, such as an expanding element or a metal spring, which upon attainment of the operating temperature of the engine lifts the movable valve member 63 of the pressure valve 57 from its seat, counter to the action of a compression spring 65, and thereby causes the diversion chamber 59 of the pressure valve 57 to communicate with the unpressurized return line 54 via a line 66.

Figure 2:
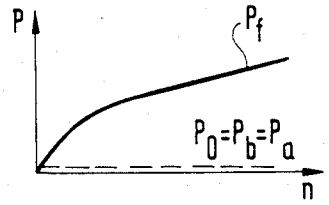
FIGS. 2 and 3 are diagrams showing the course of pressure in the suction chamber of the fuel injection pump of FIG. 1 as a function of the rpm.

In normal operation of the engine supplied with fuel by the injection pump 1, that is, whenever the engine has attained its operating temperature, the pressure control valve 18 controls the supply pressure $p_f$, which prevails in the suction chamber 2 of the injection pump 1, in the pressure chamber 49 of the pressure control valve 18 and in a pressure chamber 39 of the adjustment device 30, in proportion to the rpm n of the injection pump 1 or of the feed pump 16, as shown in the diagram in FIG. 2, where the rpm n is plotted on the abscissa and the pressure p is plotted on the ordinate. The fuel flowing through the throttle 56 to reach the restoring chamber 55 of the pressure control valve 18 then flows through the line 58 to the diversion chamber 59 and through the line 66 into the unpressurized return line 54 having the pressure $p_0$, whereupon the pressure $p_b$ in the restoring chamber 55 of the pressure control valve 18 and the pressure $p_a$ in the chamber 37 of the adjustment device 30 is adapt to the pressure $p_0$. From the diagram of FIG. 2, it will be understood that with increasing rpm n, a likewise increasing pressure difference between $p_f$ and $p_0$ or $p_a$ is established, which is definitive for the functioning of the adaptation device 30.

Figure 3:
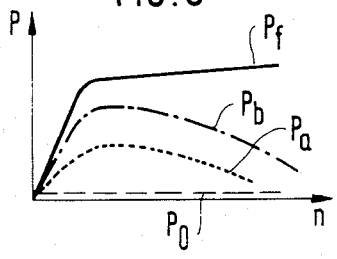

In order to differentiate between the pressure $p_b$ and $p_a$ in the restoring chamber 55 of the pressure control valve 18, in the diversion chamber 59 of the pressure valve and in the chamber 37 of the adjustment device 30 as compared with the supply pressure $p_f$ in the suction chamber 2, in the pressure chamber 49 of the pressure control valve 18 and in the pressure chamber 29 of the adjustment device 30 during cold operation or during the warmup phase of the engine, the restoring chamber 55 of the pressure control valve 18, or the diversion chamber 59 of the pressure valve 57, communicates with the return line 54 via a first throttle 70 and lines 71, 72 as well as a second throttle 75; furthermore the adaptation chamber 37 of the adjustment device 30 communicates with the restoring chamber 55 via a line 76 and the first throttle 70 and with the return line 54 via the line 72 and the second throttle 75. If the pressure valve 57 is closed or partly open, a pressure $p_b$ builds up in the restoring chamber 55 of the pressure control valve 18, because of the action of the pressure control valve 18 and of the correspondingly adapted two throttles 70 and 75; as the diagram in FIG. 3 shows, after an initial steep rise upon engine starting, this pressure $p_b$ drops steadily as the rpm n and the supply pressure $p_f$ rise. As a function of this pressure $p_b$, a pressure $p_a$ builds up downstream of the first throttle and, under the influence of the second throttle 75, in the adaptation chamber 37 of the adjustment device 30. This pressure $p_a$ is lower than the pressure $p_b$ in the restoring chamber 55, and with increasing rpm n it has a course approximately parallel to the course of the pressure $p_b$. From the diagram of FIG. 3, it will be understood that the pressure difference between the supply pressure $p_f$ and the pressure $p_a$ in the adaptation chamber 37 increases steadily with increasing rpm after engine starting. If the two diagrams of FIG. 2 and FIG. 3 are compared, it can be determined that the pressure difference between the supply pressure $p_f$ and the pressure $p_a$ in the adaptation chamber 37 of the adjustment device 30 is approximately identical both during normal operation and during cold operation with increasing rpm n, and rises identically as well. By disposing the two throttles 70 and 75 between the restoring chamber 55 of the pressure valve 18, or the diversion chamber 59 of the pressure valve 57, and the adaptation chamber 37 of the adjustment device 30, on the one hand, and the unpressurized return line 54 on the other, a differential pressure acting upon the adjustment device 30 is generated during the warmup phase—while the pressure valve 57 is closed or partly open—that is virtually equal to the differential pressure prevailing when the pressure valve 57 is open; as a result, virtually identical full-load quantity courses are attained during normal operation and during cold operation.

For adjusting the pressures in the restoring chamber 55 of the pressure control valve 18 and in the adaptation chamber 37 of the adjustment device 30, and for adapting these to one another, the throttles 70 and 75 are adjustable.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising:

a housing (4);

a fuel feed pump (16) that pumps fuel into a suction chamber (2) of said housing in proportion to rpm;

an injection onset adjusting device (43) actuated in accordance with the fuel supply pressure ($p_f$) in the suction chamber;

a pressure control valve (18) that controls the pressure in the suction chamber (2) said pressure control valve including;

a movable wall (51) actuated on one end by the supply pressure ($p_f$) and on the other end by a restoring spring (52) in a restoring chamber (55) and a differential pressure dependent on fuel supply pressure, a pressure valve (57) including a pressure chamber (59) which communicates with said restoring chamber (55) of the pressure control valve (18) and which varies the fuel pressure in the suction chamber additionally in a function of at least one operating variable, in particular the engine temperature;

a governor lever (7) actuating an injection quantity adjusting member (8) of the fuel injection pump and an adaptation device (30) which includes an adaptation control member (31), movable by supply pressure on one end and by a restoring pressure on the other end for the full-load stop for establishing a maximum permissible full-load supply quantity, the restoring force at the control member being generated by an adaptation spring (38) and a pressure ($p_a$) in the adaptation chamber (37) of the adaptation device which pressure $p_a$ is made to differ from the supply pressure and an adjustable full-load stop operative by said adaptation device, the pressure ($p_a$) in the adaptation chamber (37) of the adaptation device (30) is made to differ from the pressure ($p_b$) in the restoring chamber of the pressure control valve and in the pressure chamber (55) of the pressure valve by means of a first throttle device (70), and when the pressure valve (57) is closed in order to increase the pressure in the suction chamber (2), the pressure ($p_b$) in the restoring chamber (55) of the pressure control valve (18) and the pressure ($p_a$) in the adaptation chamber (37) of the adaptation device (30) are adjustable by means of a second throttle device (75) in a fuel return line (54).

2. A fuel injection pump as defined by claim 1, in which said first throttle device (70) is connected to the pressure chamber (59) of the pressure control valve (57) that communicates with the restoring chamber (55) of the pressure control valve (18), and that said second throttle device (75) is connected in series with said first throttle device in said fuel return line (54).

3. A fuel injection pump as defined by claim 2, in which said adaptation chamber (37) of the adaptation device (30) is connected to said fuel return line before the first throttle device (70) and the second throttle device (75).

* * * * *